US011340551B2

(12) United States Patent
Matsumura et al.

(10) Patent No.: US 11,340,551 B2
(45) Date of Patent: May 24, 2022

(54) FRAME OF IMAGE FORMING APPARATUS AND IMAGE FORMING APPARATUS

(71) Applicant: CANON KABUSHIKI KAISHA, Tokyo (JP)

(72) Inventors: Takuya Matsumura, Chiba (JP); Rin Ishikawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/230,812

(22) Filed: Apr. 14, 2021

(65) Prior Publication Data

US 2021/0356901 A1 Nov. 18, 2021

(30) Foreign Application Priority Data

May 15, 2020 (JP) ..... JP2020-086348

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS

| | | | | |
|---|---|---|---|---|
| 9,535,365 | B2 | 1/2017 | Ishikawa et al. | F16H 1/08 |
| 10,025,270 | B2 | 7/2018 | Takahashi et al. | G03G 21/206 |
| 10,082,767 | B2 | 9/2018 | Matsumura | G03G 21/1619 |
| 10,162,306 | B2 | 12/2018 | Takahashi et al. | G03G 21/206 |
| 10,216,136 | B2 | 2/2019 | Suzuki et al. | G03G 15/70 |
| 10,372,078 | B2 | 8/2019 | Narita et al. | G03G 21/1647 |
| 2008/0267659 | A1* | 10/2008 | Koyama | G03G 21/1619 399/107 |
| 2017/0219992 | A1* | 8/2017 | Yasui | G03G 21/1619 |
| 2018/0189007 | A1* | 7/2018 | Akashi | G03G 21/1619 |
| 2019/0049889 | A1 | 2/2019 | Ishikawa | G03G 15/556 |

FOREIGN PATENT DOCUMENTS

JP 2018-142025 9/2018

OTHER PUBLICATIONS

U.S. Appl. No. 17/230,836, filed Apr. 14, 2021.
U.S. Appl. No. 17/231,739, filed Apr. 15, 2021.

* cited by examiner

*Primary Examiner* — Sandra Brase
(74) *Attorney, Agent, or Firm* — Venable LLP

(57) ABSTRACT

A frame of an image forming apparatus, includes:
a bottom plate having a bottom face whose shape is substantially quadrangular;
a first caster;
a second caster;
a third caster attached near a second side of the bottom face, the third caster being disposed such that a barycenter of the image forming apparatus is located inside a triangle formed by imaginary lines connecting the first caster, the second caster, and the third caster; and
a fourth caster attached to a region outside the triangle, the fourth caster being provided closer to the second side than the barycenter, wherein
in a case where the image forming apparatus is installed on the installation face which is flat, the first caster, the second caster, and the third caster are installed on the installation face, and the fourth caster is located away from the installation face.

14 Claims, 11 Drawing Sheets

FRAME OF IMAGE FORMING APPARATUS AND IMAGE FORMING APPARATUS

BACKGROUND OF THE INVENTION

Field of the Invention

The present invention relates to a frame of an image forming apparatus, such as an electrophotographic copying machine or an electrophotographic printer (e.g., a laser-beam printer or an LED printer).

Description of the Related Art

Conventionally, as a frame of an image forming apparatus, known has been a configuration including: support members, such as a side plate and a strut, which support an image forming unit which forms an image; and a bottom plate which is disposed below the support members in the vertical direction and has the support members secured thereto. Known has been a configuration in which casters are attached to the bottom face of such a bottom plate, enabling installation of the image forming apparatus to an installation face through the casters. Note that the shape of the bottom face of such a bottom plate is often substantially quadrangular.

Such a bottom plate receives, through the support members, the weight of the entirety including, for example, the image forming unit and sheets housed in the image forming apparatus. In a case where such a bottom plate has a substantially quadrangular bottom face and has casters attached one-to-one to the four corners of the bottom face, if a minutely uneven installation face is provided, all the four casters are not necessarily installed on the installation face, and thus any three of the four casters are installed on the installation face.

In this case, for example, the image forming unit and the sheets in the apparatus weigh on the periphery of the caster away from the installation face, on the bottom plate, so that the periphery of the caster is likely to deform. Such deformation of the bottom plate causes a deviation in the position of each support member supported by the bottom plate, so that deterioration occurs in the relative positional accuracy between each member included in the image forming unit. Thus, adverse influence is likely to occur in image quality.

As a solution to such problems, Japanese Patent Application Laid-Open No. 2018-142025 discloses a configuration in which three casters are attached to a bottom plate in balance with the following arrangement. Two casters are attached, respectively, near adjacent two corner portions among the four corner portions of a substantially quadrangular bottom face that the bottom plate has. The other caster is attached near the center of a side opposed to the side connecting the two corner portions to which the two casters are attached on the substantially quadrangular bottom face of the bottom plate. Three-point installation of an image forming apparatus with such three casters enables, even in a case where a minutely uneven installation face is provided, installation of the image forming apparatus along the installation face. Therefore, with inhibition of the bottom plate from deforming, the position of each support member can be inhibited from deviating.

However, according to the configuration disclosed in Japanese Patent Application Laid-Open No. 2018-142025, for example, in a case where a user weighs down the image forming apparatus, giving a load unexpected in normal use to the periphery of either of the other two corner portions at which no casters are disposed on the bottom face of the bottom plate, the following problem is likely to occur. That is, because the load is not received on the installation face through the casters, the portion given the load in the frame falls and the entire image forming apparatus slants, so that its attitude is likely to be unstable.

SUMMARY OF THE INVENTION

It is desirable to provide a frame of an image forming apparatus, the frame having a bottom plate to which casters are attached, the frame enabling inhibition of the bottom plate from deforming and additionally inhibition of the image forming apparatus from being unstable in attitude.

According to a representative configuration of the present invention, provided is a frame of an image forming apparatus including an image forming unit configured to form a toner image on a sheet, the frame including:

a support member configured to support the image forming unit;

a bottom plate disposed below the support member in a vertical direction, the bottom plate having the support member secured to the bottom plate, the bottom plate having a bottom face to be opposed to an installation face for installation of the image forming apparatus, the bottom face being substantially quadrangular;

a first caster attached near a first corner portion of the bottom face of the bottom plate, the first caster being to be installed on the installation face;

a second caster attached near a second corner portion adjacent to the first corner portion of the bottom face of the bottom plate;

a third caster attached near a second side opposed to a first side connecting the first corner portion and the second corner portion of the bottom face of the bottom plate, the third caster being disposed such that a barycenter of the image forming apparatus is located inside a triangle formed by imaginary lines connecting the first caster, the second caster, and the third caster; and a fourth caster attached to a region outside the triangle on the bottom face of the bottom plate, the fourth caster being provided closer to the second side than the barycenter of the image forming apparatus in a direction orthogonal to the first side on the bottom face, the fourth caster being provided at a position different from the third caster in a direction in which the first side extends, wherein in a case where the image forming apparatus is installed on the installation face which is flat, the first caster, the second caster, and the third caster are installed on the installation face, and the fourth caster is located away from the installation face.

Further features of the present invention will become apparent from the following description of exemplary embodiments with reference to the attached drawings.

DESCRIPTION OF THE EMBODIMENTS

<Image Forming Apparatus>

The entire configuration of an image forming apparatus according to an embodiment of the present invention will be described below together with the operation at the time of image forming with reference to the drawings. Note that, unless otherwise specified, the scope of the invention is not limited to the dimensions, materials, and shapes of the following constituent components and the relative arrangements thereof.

The image forming apparatus A according to the present embodiment is of an intermediate tandem type which transfers four-color toners of yellow Y, magenta M, cyan C, and black K to an intermediate transfer belt and then transfers an image to a sheet to form the image. Note that, in the following description, members which involve the yellow toner are denoted with Y as the suffix, members which involve the magenta toner are denoted with M as the suffix, members which involve the cyan toner are denoted with C as the suffix, and members which involve the black toner are denoted with K as the suffix. However, the configurations and operations of the members are substantially the same except for the colors of toner. Thus, the suffixes thereof will be appropriately omitted when no distinction is required.

Figure 1:
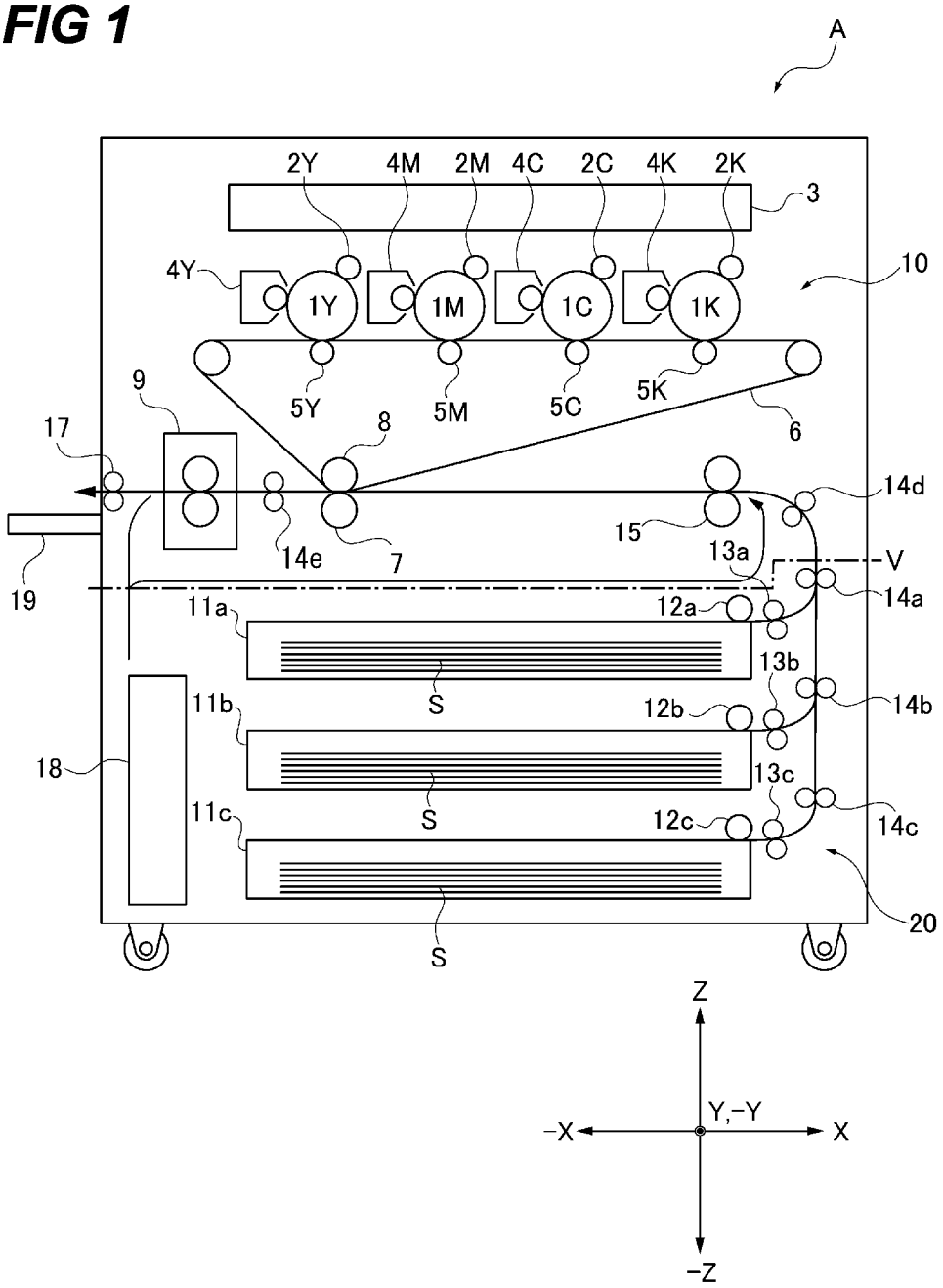
FIG. 1 is a schematic sectional view of an image forming apparatus.

FIG. 1 is a schematic sectional view of the image forming apparatus A. As illustrated in FIG. 1, the image forming apparatus A includes: an image forming unit 10 which forms an image on a sheet S; and a feed unit 20 which feeds the sheet S to the image forming unit 10.

The image forming unit 10 includes photoconductive drums 1 (1Y, 1M, 1C, and 1K), charging rollers 2 (2Y, 2M, 2C, and 2K), and developing devices 4 (4Y, 4M, 4C, and 4K). The image forming unit 10 includes primary transfer rollers 5 (5Y, 5M, 5C, and 5K), a laser scanner unit 3, an intermediate transfer belt 6, a secondary transfer roller 7, and a secondary transfer counter roller 8.

The feed unit 20 includes: sheet cassettes 11*a* to 11*c* which each house sheets S; and pickup rollers 12*a* to 12*c* which each pick up a sheet S housed in the corresponding sheet cassette 11*a*, 11*b*, or 11*c*. The feed unit 20 includes: feed rollers 13*a* to 13*c* which each feed the sheet S picked up by the corresponding pickup roller 12*a*, 12*b*, or 12*c* to a conveyance path; conveying rollers 14*a* to 14*d* which each convey the sheet S on the conveyance path; and a registration roller 15.

At the time of formation of an image by the image forming apparatus A, first, an image forming job signal is input to a controller not illustrated. This arrangement causes a sheet S housed in any of the sheet cassettes 11*a* to 11*c* to be picked up by the corresponding pickup roller 12*a*, 12*b*, or 12*c*. Next, the sheet S is sent to the registration roller 15 by the corresponding feed roller 13*a*, 13*b*, or 13*c* and conveying roller 14*a*, 14*b*, 14*c*, or 14*d*. After that, the sheet S is subjected to correction of skew by the registration roller 15. Then, at a predetermined timing, the sheet S is sent to a secondary transfer portion formed by the secondary transfer roller 7 and the secondary transfer counter roller 8.

Meanwhile, in the image forming unit 10, first, the surface of the photoconductive drum 1Y is charged by the charging roller 2Y. After that, according to image data transmitted from external equipment not illustrated, the laser scanner unit 3 irradiates the surface of the photoconductive drum 1Y with laser light, to form an electrostatic latent image on the surface of the photoconductive drum 1Y. After that, the developing device 4Y causes the yellow tonner to adhere to the electrostatic latent image formed on the surface of the photoconductive drum 1Y, so that a yellow toner image is formed on the surface of the photoconductive drum 1Y. In response to application of a primary transfer bias to the primary transfer roller 5Y, the tonner image formed on the surface of the photoconductive drum 1Y is primary-transferred to the intermediate transfer belt 6.

In similar processes, a magenta toner image, a cyan toner image, and a black toner image are formed on the photoconductive drums 1M, 1C, and 1K, respectively. Then, in response to application of a primary transfer bias to each of the primary transfer rollers 5M, 5C, and 5K, the corresponding toner image is transferred so as to be superimposed on the yellow toner image on the intermediate transfer belt 6. This arrangement results in formation of a full-color toner image, corresponding to the image signal, on the surface of the intermediate transfer belt 6. Note that, after the primary transfer, the toners adhering to the photoconductive drums 1Y, 1M, 1C, and 1K are each removed by a cleaning member not illustrated, resulting in being collected in a toner collection container 18.

After that, the full-color toner image is sent to the secondary transfer portion by a circumferential run of the intermediate transfer belt 6. Then, in response to application of a secondary transfer bias to the secondary transfer roller 7, the full-color toner image on the intermediate transfer belt 6 is transferred to the sheet S at the secondary transfer portion. The sheet S to which the toner image is transferred is conveyed to a fixing device 9 by a conveying roller 14*e*. Then, the sheet S is subjected to heating and pressing by the fixing device 9, so that the toner image on the sheet S is fixed to the sheet S. After that, the sheet S to which the toner image is fixed is discharged to a discharge tray 19 by a discharge roller 17.

<Frame for Image Forming Apparatus>

Next, the configuration of a frame 100 for the image forming apparatus A will be described.

Figure 2:
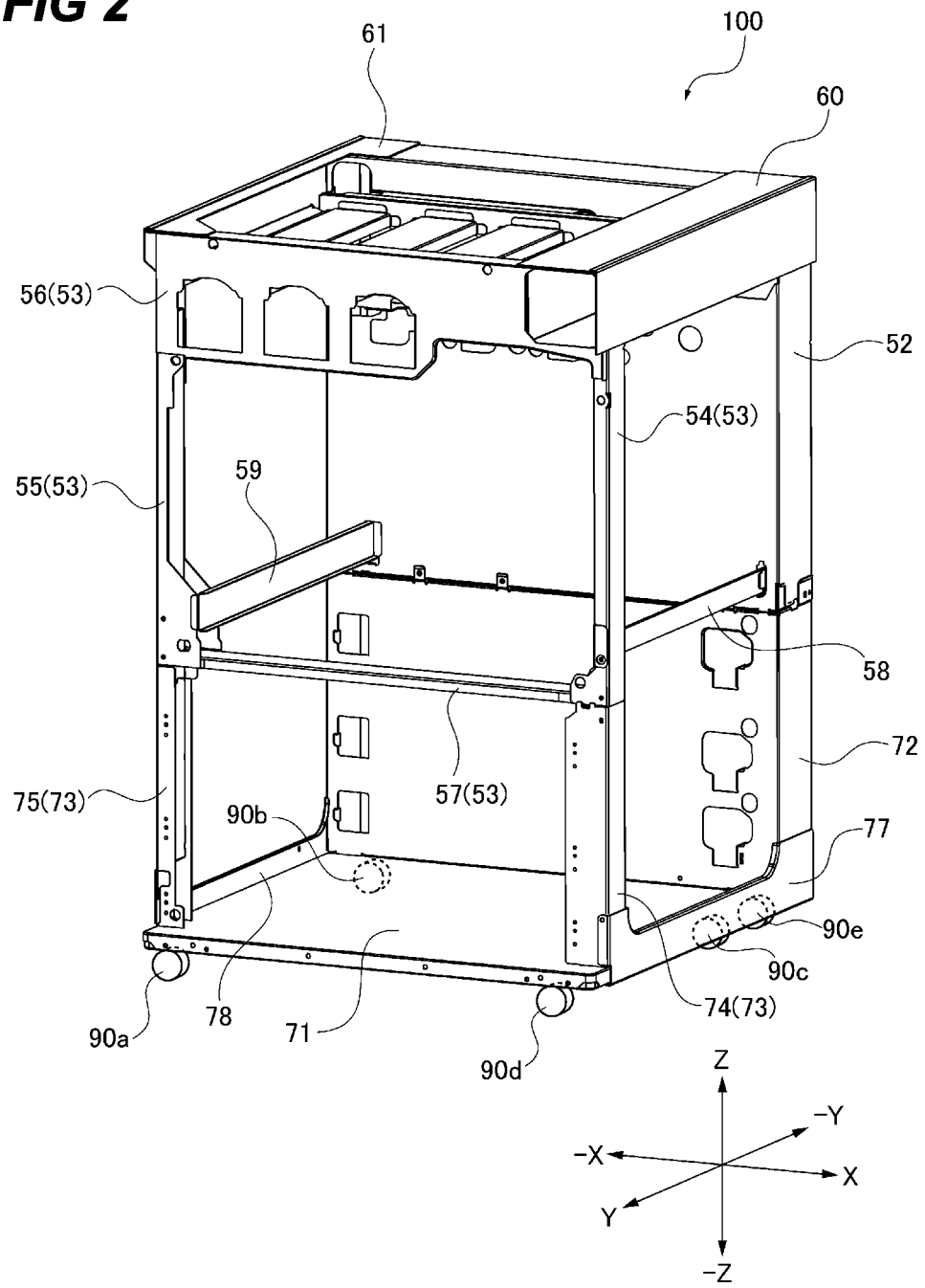
FIG. 2 is a perspective view of a frame of the image forming apparatus.
Figure 3:
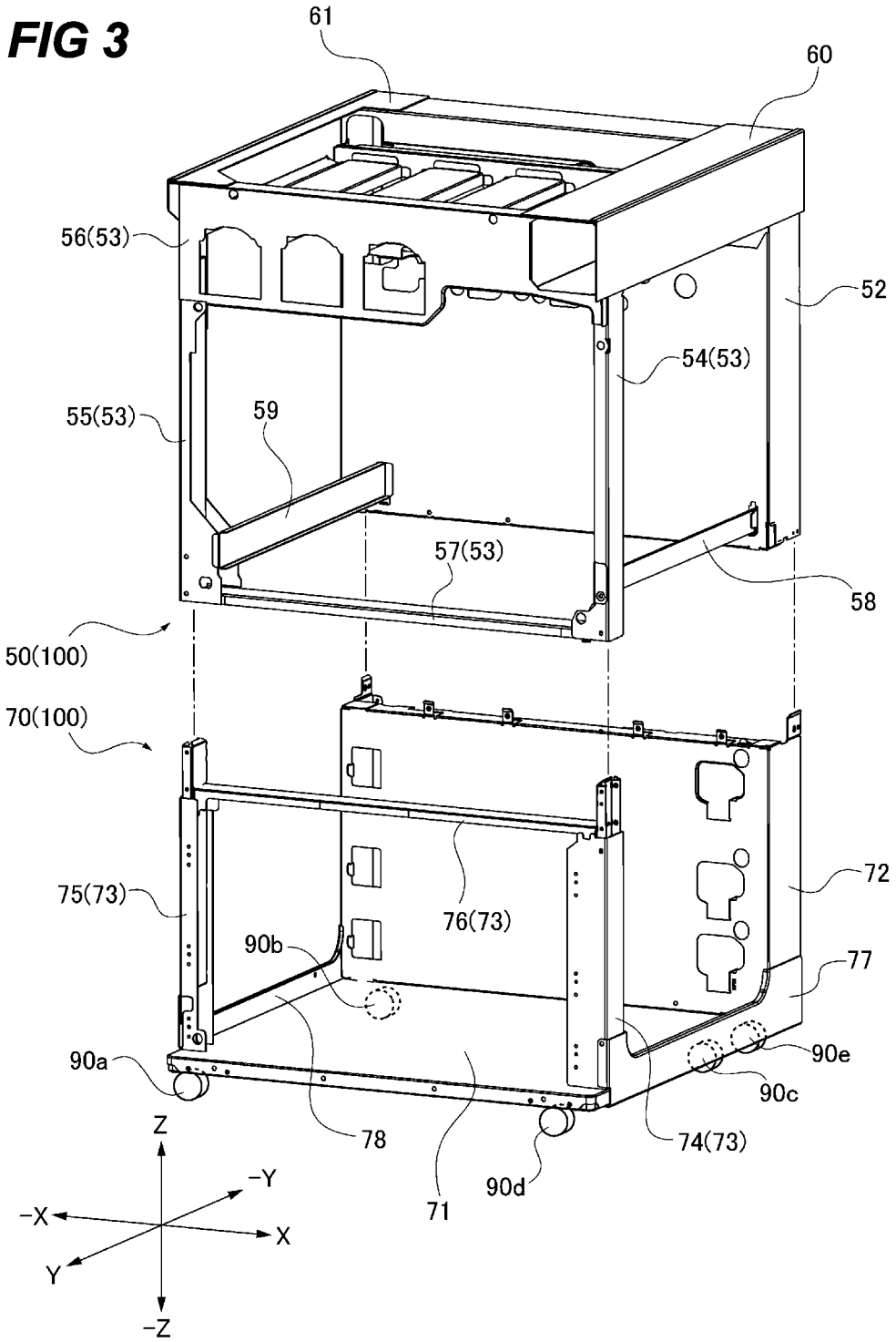
FIG. 3 is an exploded perspective view of the frame of the image forming apparatus.

FIG. 2 is a perspective view of the frame 100 for the image forming apparatus A. FIG. 3 is an exploded perspective view of the frame 100 for the image forming apparatus A. As illustrated in FIGS. 2 and 3, the frame 100 for the image forming apparatus A includes an upper frame 50 and a lower frame 70 coupled together. The upper frame 50 and the lower frame 70 are each made of sheet metal. The upper frame 50 is disposed at the upper portion in the vertical direction of the lower frame 70. Note that the lower frame 70 is to be, as the frame 100, incorporated normally with the image forming apparatus A and thus is different from a cassette pedestal unit which is optionally attached as an option for functional extension, such as an increase in the number of sheets S to be housed. A dot-and-dash line V illustrated in FIG. 1 indicates the boundary between the upper frame 50 and the lower frame 70.

The upper frame 50 includes a front plate 53, a rear plate 52, and stays 58, 59, 60, and 61 which couple the front plate 53 and the rear plate 52 together. The front plate 53 includes an upper-right strut 54, an upper-left strut 55, and stays 56 and 57 which couple the upper-right strut 54 and the upper-left strut 55 together. The stays 56 and 57 are welded to the upper-right strut 54 and the upper-left strut 55. The stay 58 is welded to the upper-right strut 54 and the rear plate 52. The stay 59 is welded to the upper-left strut 55 and the rear plate 52. The stays 60 and 61 are welded to the stay 56 and the rear plate 52.

The lower frame 70 includes a bottom plate 71, a front plate 73, a rear plate 72, and stays 77 and 78 coupled to the front plate 73, the rear plate 72, and the bottom plate 71. The front plate 73 includes a lower-right strut 74, a lower-left strut 75, and a stay 76 which couples the lower-right strut 74 and the lower-left strut 75 together. The lower-right strut 74 is secured, through a screw not illustrated, to the upper-right strut 54 of the upper frame 50. The lower-left strut 75 is secured, through a screw not illustrated, to the upper-left strut 55 of the upper frame 50. The rear plate 72, the lower-right strut 74, and the lower-left strut 75 are secured, through screws not illustrated, to the bottom plate 71. The stay 76 is welded to the lower-right strut 74 and the lower-left strut 75. The stay 77 is secured, through screws not illustrated, to the lower-right strut 74, the rear plate 72, and the bottom plate 71. The stay 78 is secured, through screws not illustrated, to the lower-left strut 75, the rear plate 72, and the bottom plate 71.

Five casters 90*a* to 90*e* are attached to a bottom face 71*v* (attachment face) of the bottom plate 71 of the lower frame 70. The casters 90*a* to 90*e* are used at the time of movement of the image forming apparatus A or at the time of installation of the image forming apparatus A. The configuration of the casters 90*a* to 90*e* will be described in detail later.

Figure 4:
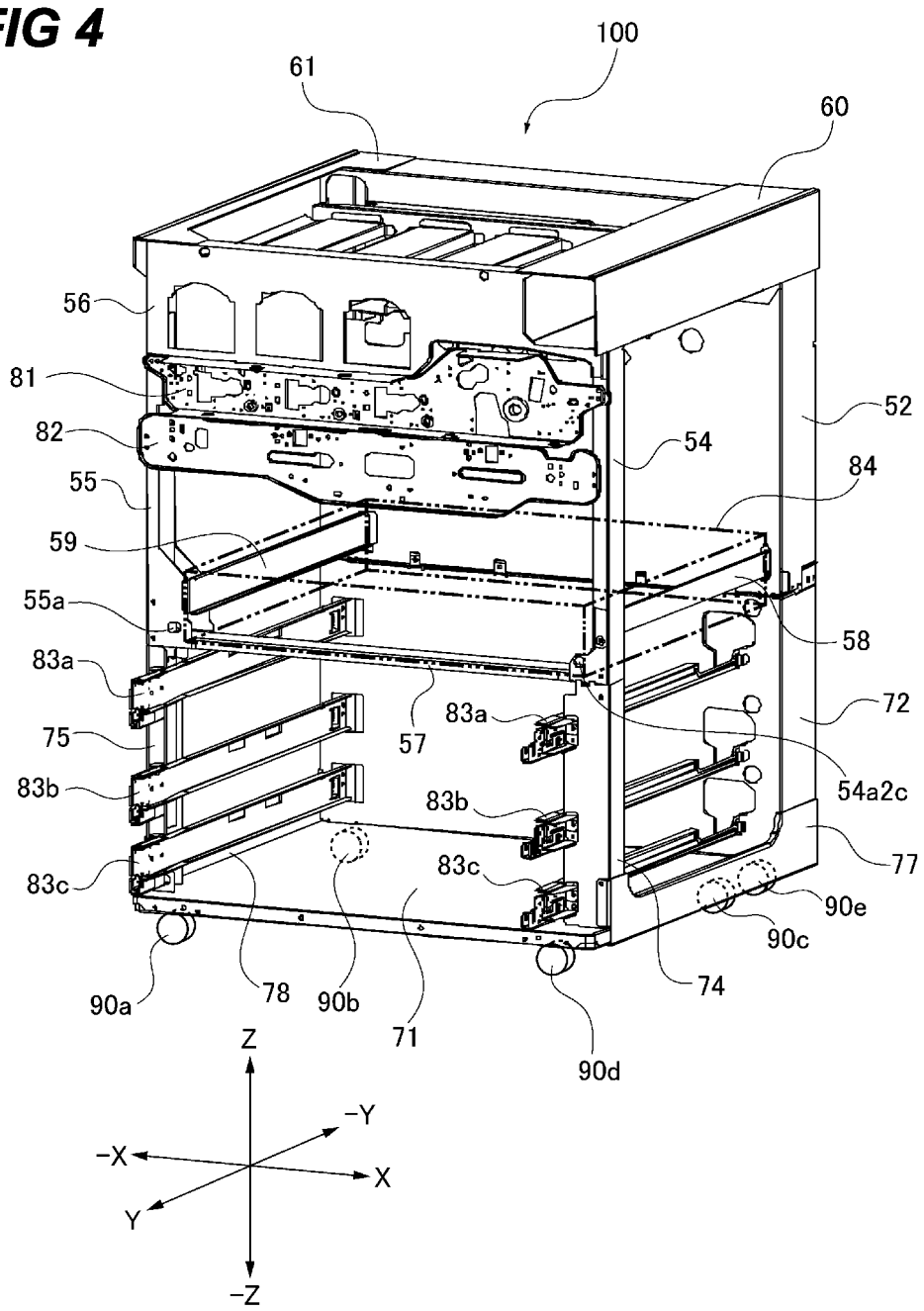
FIG. 4 is a perspective view of the frame of the image forming apparatus.

FIG. 4 illustrates the frame 100 for the image forming apparatus A, to which members which support the photoconductive drums 1 and the sheet cassettes 11 are attached. As illustrated in FIG. 4, a drum support member 81 which supports the photoconductive drums 1 and the developing devices 4, is positioned and attached to the upper-right strut 54 and the upper-left strut 55 of the upper frame 50. The drum support member 81 supports, rotatably, one end portion in the direction of the rotational axis of each of the photoconductive drums 1 and developing sleeves, not illustrated, included in the developing devices 4. The other end portion in the direction of the rotational axis of each of the photoconductive drums 1 and the developing sleeves is supported rotatably by the rear plate 52.

A belt support member 82 which supports the intermediate transfer belt 6 is positioned and attached to the upper-right strut 54 and the upper-left strut 55 of the upper frame 50. The belt support member 82 supports, rotatably, one end portion in the direction of the rotational axis of each of the secondary transfer counter roller 8 and the other rollers around which the intermediate transfer belt 6 is stretched. The other end portion in the direction of the rotational axis of the secondary transfer counter roller 8 is supported rotatably by the rear plate 52.

A front plate as the frame on the front side of a fixing and conveying unit 84 (fixing unit) including the fixing device 9 and the conveying roller 14*e* united together, is attached to the upper-right strut 54 and the upper-left strut 55 of the upper frame 50. The position of the fixing and conveying unit 84 to the upper-right strut 54 and the upper-left strut 55 is determined by one-to-one fitting of pins, not illustrated, on the front plate of the fixing and conveying unit 84 to a fitting hole 54*a*2*c* formed on the upper-right strut 54 and a fitting hole 55*a* formed on the upper-left strut 55. The fixing and conveying unit 84 is capable of moving between the mount position at which the fixing and conveying unit 84 is mounted in the image forming apparatus A in order to perform fixing and the drawn position at which the fixing and conveying unit 84 is drawn out of the mount position to allow a user to carry out, for example, jam recovery.

That is, for example, the photoconductive drums 1, the developing devices 4, and the intermediate transfer belt 6 each serving as part of the image forming unit 10, are supported by the rear plate 52, the upper-right strut 54, and the upper-left strut 55 through the drum support member 81 or the belt support member 82. The rear plate 72, the lower-right strut 74, and the lower-left strut 75 coupled, from below in the vertical direction, to the rear plate 52, the upper-right strut 54, and the upper-left strut 55, receive the load of the photoconductive drums 1, the developing devices 4, and the intermediate transfer belt 6 and support the members indirectly. That is the drum support member 81, the belt support member 82, the rear plate 52, the upper-right strut 54, and the upper-left strut 55 of the upper frame 50, the rear plate 72, the lower-right strut 74, and the lower-left strut 75 of the lower frame 70 are each a support member which supports the image forming unit 10. The bottom plate 71 is disposed, in the vertical direction, below each support member which supports the image forming unit 10, and secures the rear plate 72, the lower-right strut 74, and the lower-left strut 75 which are part of the support members which support the image forming unit 10.

The conveying roller 14*d* is supported by the frame of the fixing and conveying unit 84. That is, determination of the position of the fixing and conveying unit 84 to the upper-right strut 54 and the upper-left strut 55 causes determination of the position of the conveying roller 14*d*. One end portion in the direction of the rotational axis of the conveying roller 14*a* which feeds a sheet S to the conveying roller 14*d*, is positioned to and then is supported rotatably by the lower-right strut 74. The other end portion in the direction of the rotational axis of the conveying roller 14*a* is supported rotatably by the rear plate 52.

A support rail 83*a* which supports the sheet cassette 11*a*, a support rail 83*b* which supports the sheet cassette 11*b*, and a support rail 83*c* which supports the sheet cassette 11*c* are positioned and attached to each of the lower-right strut 74 and the lower-left strut 75 of the lower frame 70. The support rails 83*a*, 83*b*, and 83*c* serve as stays which couple the lower-right strut 74, the lower-left strut 75, and the rear plate 72 together. At the position between the lower-right strut 74 and the lower-left strut 75, the sheet cassettes 11*a* to 11*c* slide-move while being guided by the support rails 83*a* to 83*c*. The sheet cassettes 11*a* to 11*c* are inserted in the direction of arrow −Y so as to be mounted in the image forming apparatus A. The sheet cassettes 11*a* to 11*c* mounted in the image forming apparatus A are supported by the support rails 83*a* to 83*c* and the rear plate 72. The sheet cassettes 11*a* to 11*c* are capable of moving between the mount position at which the sheet cassettes 11*a* to 11*c* are mounted in the image forming apparatus A and the drawn position at which the sheet cassettes 11*a* to 11*c* are drawn out of the mount position in the direction of arrow Y. The user replenishes, with sheets S, each of the sheet cassettes 11*a* to 11*c* at the drawn position.

In the present embodiment, the front face of the image forming apparatus A is oriented in the direction of arrow Y in which the sheet cassettes 11*a* to 11*c* are drawable, and the rear face of the image forming apparatus A is oriented in the direction of arrow −Y in which the sheet cassettes 11*a* to 11*c* are insertable. The right face of the image forming apparatus A is oriented in the direction of arrow X orthogonal to the directions of arrows Y and −Y and the directions of arrows Z and −Z along the vertical direction. The left face of the image forming apparatus A is oriented in the direction of arrow −X inverse to the direction of arrow X. That is, in the direction of movement of the sheet cassettes 11*a* to 11*c*, the lower-right strut 74 and the lower-left strut 75 are disposed opposed to the rear plate 72 in the lower frame 70. The lower-right strut 74 and the lower-left strut 75 are disposed opposed to each other in the direction orthogonal to the direction of movement of the sheet cassettes 11*a* to 11*c* and the vertical direction.

<Casters>

Next, the configuration of the casters 90*a* to 90*e* will be described.

Figure 5:
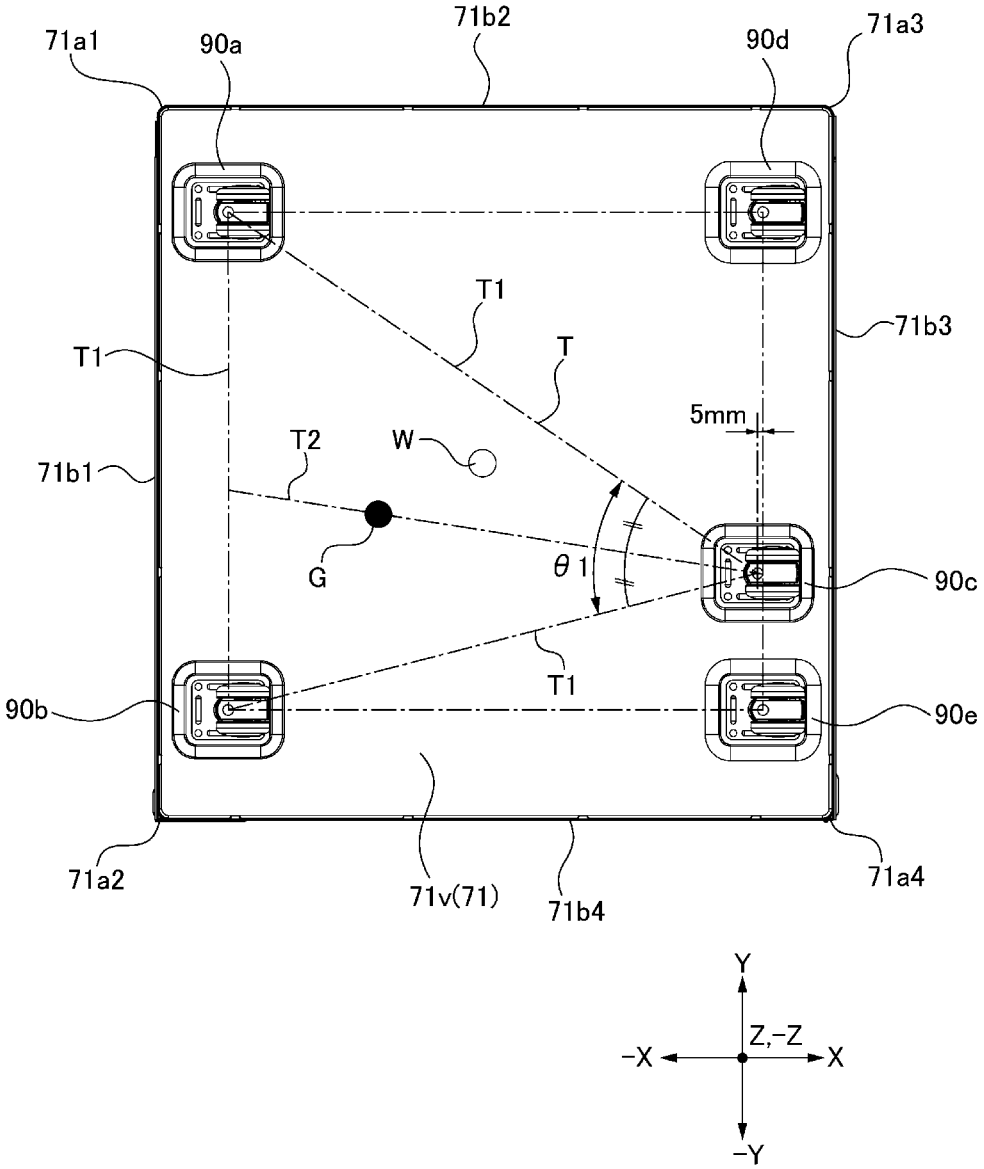
FIG. 5 illustrates a bottom plate viewed in the direction of arrow Z.
Figure 6:
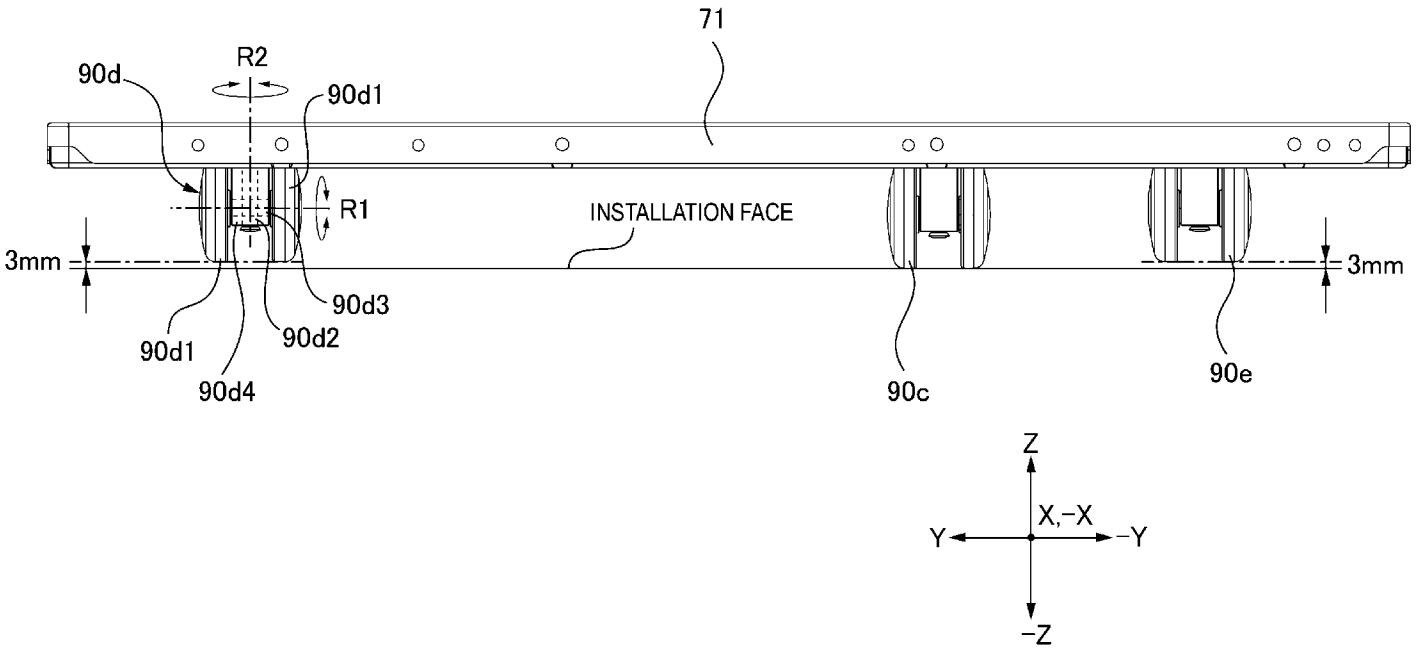
FIG. 6 illustrates the bottom plate viewed in the direction of arrow −X.

FIG. 5 illustrates the bottom plate 71 viewed in the direction of arrow Z. FIG. 6 illustrates the bottom plate 71 viewed in the direction of arrow −X. As illustrated in FIGS. 5 and 6, the bottom face 71*v* of the bottom plate 71 has four sides 71*b*1 to 71*b*4 and is substantially quadrangular with the edges chamfered. The five casters 90*a* to 90*e* are attached to the bottom face 71*v*. The bottom face 71*v* of the bottom plate 71 herein is a face of the bottom plate 71 which is opposed to an installation face for the image forming apparatus A. In other words, the bottom plate 71 has an outer edge substantially quadrangular when the face on which the casters 90*a* to 90*e* are attached is viewed. Note that examples of the substantially quadrangle of the bottom face 71*v* of the bottom plate 71 include a shape having a non-right angle between each of the sides 71*b*1 to 71*b*4 of the bottom face 71*v*. In the present embodiment, the direction of arrow X is orthogonal to the side 71*b*1, and the direction of arrow Y is identical to the direction in which the side 71*b*1 extends.

The casters 90*a* to 90*e* are similar in configuration, and thus the caster 90*d* will be described exemplarily. As illustrated in FIG. 6, the caster 90*d* includes a pair of wheels 90*d*1, a shaft 90*d*3 as a rotational shaft for the wheels 90*d*1, and a holder 90*d*4 which holds the shaft 90*d*3. The two wheels 90*d*1 are installed on the installation face and rotate, in either of the directions of arrows R1, around the shaft 90*d*3 as the center of rotation. The holder 90*d*4 is supported by a pivot 90*d*2 held at the bottom plate 71 and is pivotable, in either of the directions of arrows R2, around the pivot 90*d*2.

As illustrated in FIG. 5, the casters 90*a*, 90*b*, 90*d*, and 90*e* are disposed, respectively, near the four corners of the substantially quadrangular bottom face 71*v* of the bottom plate 71. Specifically, the caster 90*a* (first caster) is disposed near a corner portion 71*a*1 (first corner portion) of the bottom face 71*v* of the bottom plate 71. The caster 90*b* (second caster) is disposed near a corner portion 71*a*2 (second corner portion) of the bottom face 71*v* of the bottom plate 71. The caster 90*d* (fourth caster) is disposed near a corner portion 71*a*3 of the bottom face 71*v* of the bottom plate 71 and outside a triangle T to be described later. The caster 90*e* (fifth caster) is disposed near a corner portion 71*a*4 of the bottom face 71*v* of the bottom plate 71 and outside the triangle T to be described later. Note that, among the casters 90*a* to 90*e*, the caster 90*b* is located closest to the barycentric position G of the image forming apparatus A.

Figure 7:
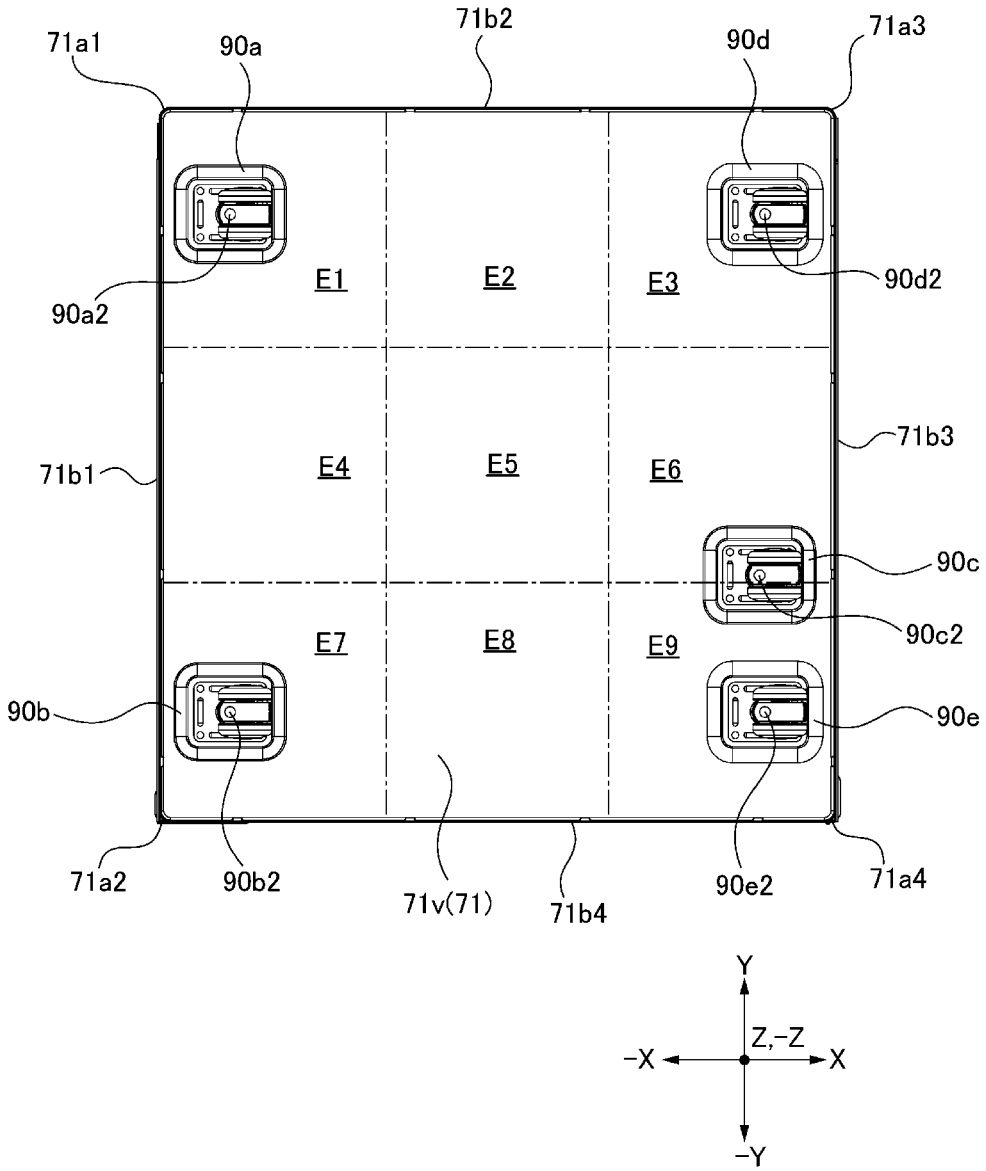
FIG. 7 illustrates the bottom plate viewed in the direction of arrow Z.

The vicinities of the corner portions 71*a*1 to 71*a*4 of the bottom face 71*v* of the bottom plate 71 in which the casters 90*a*, 90*b*, 90*d*, and 90*e* are disposed mean the following positions. As illustrated in FIG. 7, first, the substantially quadrangular bottom face 71*v* of the bottom plate 71 is divided into nine regions (regions E1 to E9) in a 3-by-3 matrix. In this case, the pivot 90*a*2 of the caster 90*a* is disposed in the region E1 in which the corner portion 71*a*1 is located. The pivot 90*b*2 of the caster 90*b* is disposed in the region E7 in which the corner portion 71*a*2 is located. The pivot 90*d*2 of the caster 90*d* is disposed in the region E3 in which the corner portion 71*a*3 is located. The pivot 90*e*2 of the caster 90*e* is disposed in the region E9 in which the corner portion 71*a*4 is located. Note that, as the casters 90*a*, 90*b*, 90*d*, and 90*e* are each disposed closer to the edge portion on the bottom face 71*v* of the bottom plate 71, the image forming apparatus A is installed on the installation face more stably.

The caster 90*c* (third caster) is attached near the side 71*b*3 (second side) opposed to the side 71*b*1 (first side) connecting the corner portion 71*a*1 and the corner portion 71*a*2 of the substantially quadrangular bottom face 71*v* of the bottom plate 71. The vicinity of the side 71*b*3 of the substantially quadrangular bottom face 71*v* of the bottom plate 71 in which the caster 90*c* is disposed means the following position. That is the pivot 90*c*2 of the caster 90*c* is disposed inside any of the regions E3, E6, and E9 as the region of the column closest to the side 71*b*3, among the regions E1 to E9 illustrated in FIG. 7.

The caster 90*c* is disposed such that the barycentric position G of the image forming apparatus is located inside the triangle T formed by imaginary lines T1 connecting the casters 90*a*, 90*b*, and 90*c*. Specifically, the caster 90*c* is disposed such that the barycentric position G is located on the bisector T2 of the angle θ1 between the imaginary line connecting the casters 90*a* and 90*c* and the imaginary line connecting the casters 90*b* and 90*c*. Such disposition of the caster 90*c* causes the barycentric position G to remain easily inside the triangle T even in a case where the barycentric position G changes due to a change in the amount of sheets S housed in each of the sheet cassettes 11*a* to 11*c* or a change in the amount of toner in a toner bottle, not illustrated, which houses toner.

Note that, in the present embodiment, the barycentric position G of the image forming apparatus A is measured with each toner bottle, not illustrated, filled with toner to be supplied to the corresponding developing device 4 and the sheet cassettes 11*a* to 11*c* each housing no sheet S. In the present embodiment, the barycentric position G of the image forming apparatus A deviates from the center position W of the image forming apparatus A. In the present embodiment, the triangle T is formed by the imaginary lines T1 connecting the centers of pivoting of the casters 90*a*, 90*b*, and 90*c*.

As illustrated in FIG. 6, the casters 90*d* and 90*e* are disposed such that the respective lower end portions of the casters 90*d* and 90*e* are above the lower end portion of the caster 90*c* in the vertical direction. The casters 90*a* and 90*b* are disposed such that the respective lower end portions of the casters 90*a* and 90*b* are at the same level in the vertical direction as the lower end portion of the caster 90*c* is. That is the casters 90*a* to 90*c* are disposed such that the respective lower end portions of the casters 90*a* to 90*c* are lower than the respective lower end portions of the casters 90*d* and 90*e*. In the present embodiment, the casters 90*d* and 90*e* are disposed such that the lower end portions of the wheels of the casters 90*d* and 90*e* are higher by 3 mm than the lower end portions of the wheels of the casters 90*a* to 90*c*. With such a configuration, in a case where the image forming apparatus A is installed on a flat installation face, the casters 90*a* to 90*c* are installed on the installation face, and the casters 90*d* and 90*e* are located away from the installation face.

Such three-point installation of the image forming apparatus A with the three casters 90*a* to 90*c* on an installation face causes, even in a case where the installation face is minutely uneven, the casters to remain on the installation face. Thus, the image forming apparatus A can be installed along the installation face. The three casters 90*a* to 90*c* are disposed in balance such that the triangle T involves the barycentric position G of the image forming apparatus A, so that the three casters 90*a* to 90*c* receive load equally easily. Therefore, any unintended portion in the bottom plate 71 is inhibited from being given an excessive force. Thus, the bottom plate 71 is inhibited from deforming, so that the support members, such as the rear plate 72, which support the image forming unit 10, are inhibited from deviating in position. Thus, deterioration is inhibited from occurring in the relative positional accuracy between each member included in the image forming unit 10, so that deterioration can be inhibited from occurring in image quality.

For example, in a case where the user weighs down the image forming apparatus A, giving a load unexpected in normal use to the periphery of the corner portion 71*a*3 of the bottom face 71*v* of the bottom plate 71, the periphery of the corner portion 71*a*3 falls downward, so that the casters 90*a* and 90*b* intend to be away from the installation face. That is the entirety of the image forming apparatus A intends to slant. In a case where the periphery of the corner portion 71*a*4 of the bottom face 71*v* of the bottom plate 71 is given a load unexpected in normal use, the same applies. In either of the cases, because the casters 90*d* and 90*e* outside the triangle T are disposed closer to the side 71*b*3 than the barycentric position G of the image forming apparatus A in the direction of arrow X and are disposed differently from the caster 90*c* in the direction of arrow Y, the corresponding caster 90*d* or 90*e* comes in contact with the installation face. Thus, the corresponding caster 90*d* or 90*e* functions as an auxiliary wheel and receives repulsive force from the installation face, to inhibit the image forming apparatus A from slanting. Therefore, the image forming apparatus A can be inhibited from being unstable in attitude. Note that even a configuration in which one of the casters 90*d* and 90*e* is provided enables acquisition of an effect of inhibiting the image forming apparatus A from being unstable in attitude.

Figure 8:
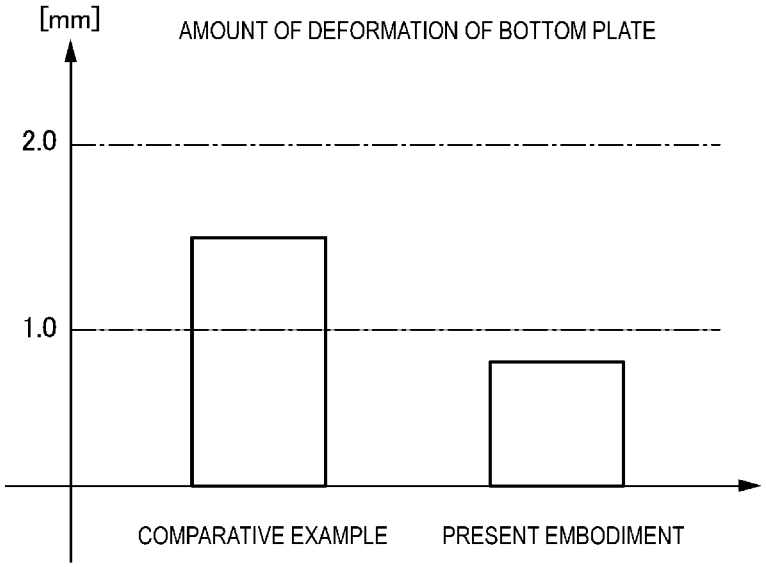
FIG. 8 is a graph of comparative experimental results of the amount of deformation of the bottom plate.

Due to the following reason, the caster 90*c* can be disposed between the caster 90*d* and the caster 90*e* in the direction of arrow Y. FIG. 8 is a graph of comparative experimental results of the amount of deformation on the periphery of the corner portion 71*a*3 of the bottom plate 71 due to the weight of the image forming apparatus A itself, between the configuration according to the present embodiment and a configuration according to a comparative example. In the configuration according to the comparative example, the casters 90*a*, 90*b*, and 90*e* are installed on an installation face. As illustrated in FIG. 8, the amount of deformation of the corner portion 71*a*3 of the bottom plate 71 in the configuration according to the present embodiment is approximately half of that in the configuration according to the comparative example. This is because the distance between the corner portion 71*a*3 and the caster provided by the side 71*b*3 of the bottom face 71*v* of the bottom plate 71 is shorter in the configuration according to the present embodiment in which the caster 90*c* is installed on the installation face than in the configuration according to the comparative example in which the caster 90*e* is installed on the installation face.

Note that, in the present embodiment, in the direction of arrow X, the casters 90*d* and 90*e* are disposed closer to the side 71*b*3 of the bottom face 71*v* of the bottom plate 71 than the caster 90*c* is. However, any configuration in which the casters 90*d* and 90*e* are disposed closer to the side 71*b*3 than the barycentric position G of the image forming apparatus A at least in the direction of arrow X enables inhibition of the image forming apparatus A from slanting, with the casters 90*d* and 90*e* each functioning as an auxiliary wheel. As the casters 90*d* and 90*e* are closer to the side 71*b*3, the image forming apparatus A is more easily inhibited from slanting. Therefore, the casters 90*d* and 90*e* can be disposed such that part of each of the casters 90*d* and 90*e* overlap part of the caster 90*c* in the direction of arrow X.

As illustrated in FIG. 5, in the direction of arrow X, the caster 90*d* is disposed closer by 5 mm to the side 71*b*3 of the bottom face 71*v* of the bottom plate 71 than the caster 90*c* is. Similarly, the caster 90*e* is disposed closer by 5 mm to the side 71*b*3 of the bottom face 71*v* of the bottom plate 71 than the caster 90*c* is. Such a configuration causes, when the image forming apparatus A is moved in the direction of arrow X to get over a step, the casters 90*d* and 90*e* to hit the step before the caster 90*c* hits the step, so that impact to be given to the caster 90*c* can be reduced. Therefore, the caster 90*c* for normal use can be protected by the casters 90*d* and 90*e* which each function as an auxiliary wheel.

In the present embodiment, the caster 90*d* and the caster 90*a* are disposed identically in position in the direction of arrow Y. However, the caster 90*d* may be disposed closer to the side 71*b*2 of the bottom face 71*v* of the bottom plate 71 than the caster 90*a* is. Thus, when the image forming apparatus A is moved in the direction of arrow Y to get over a step, the caster 90*d* hits the step before the caster 90*a* hits the step, so that impact to be given to the caster 90*a* can be reduced.

In the present embodiment, the caster 90*e* and the caster 90*b* are disposed identically in position in the direction of arrow Y. However, the caster 90*e* may be disposed closer to the side 71*b*4 of the bottom face 71*v* of the bottom plate 71 than the caster 90*b* is. Thus, when the image forming apparatus A is moved in the direction of arrow −Y to get over a step, the caster 90*e* hits the step before the caster 90*b* hits the step, so that impact to be given to the caster 90*b* can be reduced.

Figure 9:
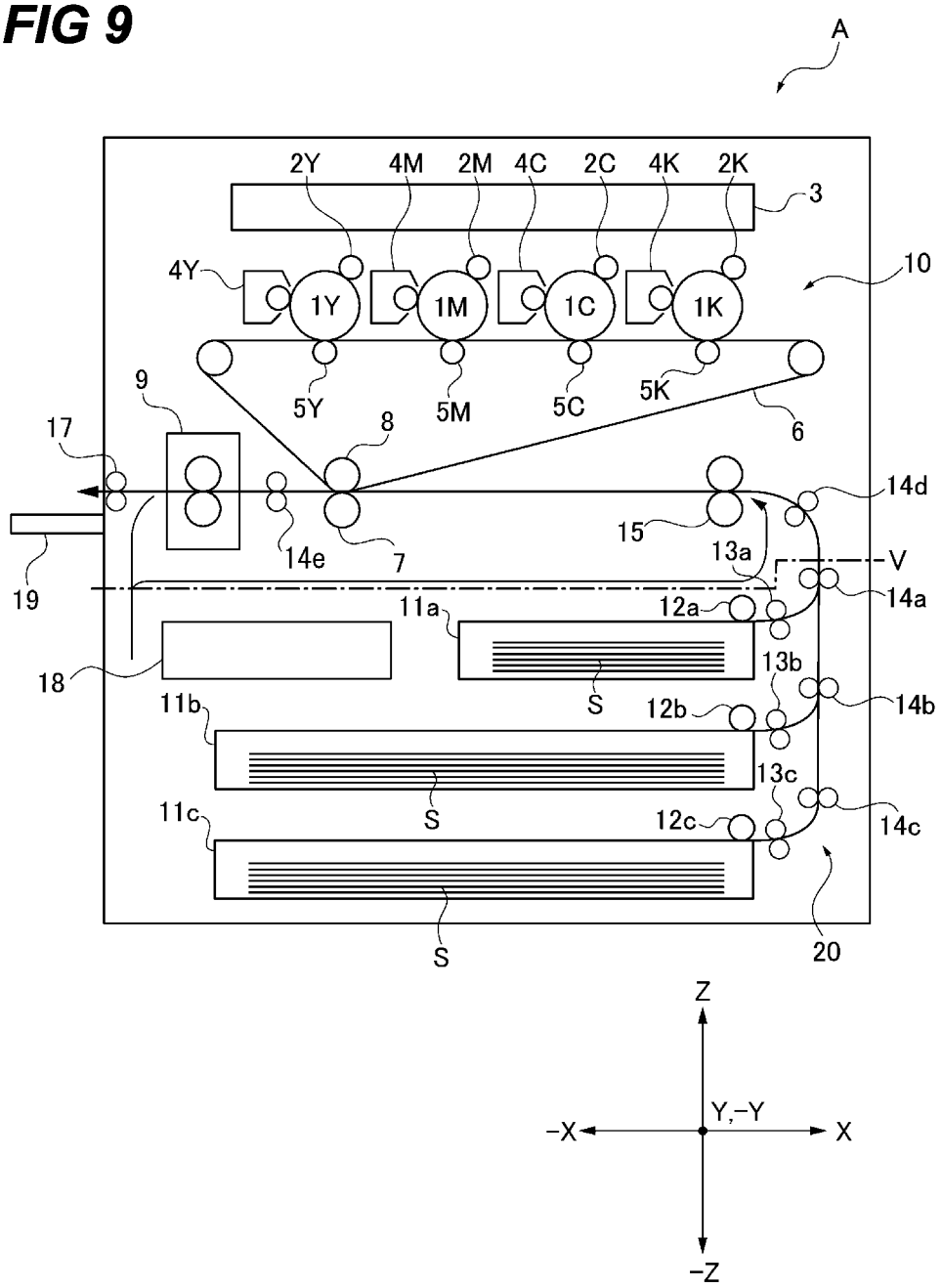
FIG. 9 is a schematic sectional view of an image forming apparatus.

In the present embodiment, the arrangement of each member supported by the upper frame 50 or the lower frame 70 can be changed appropriately. For example, as illustrated in FIG. 9, the sheet cassette 11*a*, which is supported by the lower frame 70, may be miniaturized to house small-sized sheets S. In addition, the toner collection container 18 may be disposed at a space resulting from the miniaturization.

As above, in a case where the arrangement of a member which is supported by the upper frame 50 or the lower frame 70 is changed, the barycentric position G of the image forming apparatus A changes. For example, as illustrated in FIG. 10, given is a case where the barycentric position G of the image forming apparatus A moves in the direction of arrow X from the position illustrated in FIG. 5, due to a change in the arrangement of a member which is supported by the frame 100.

Figure 10:
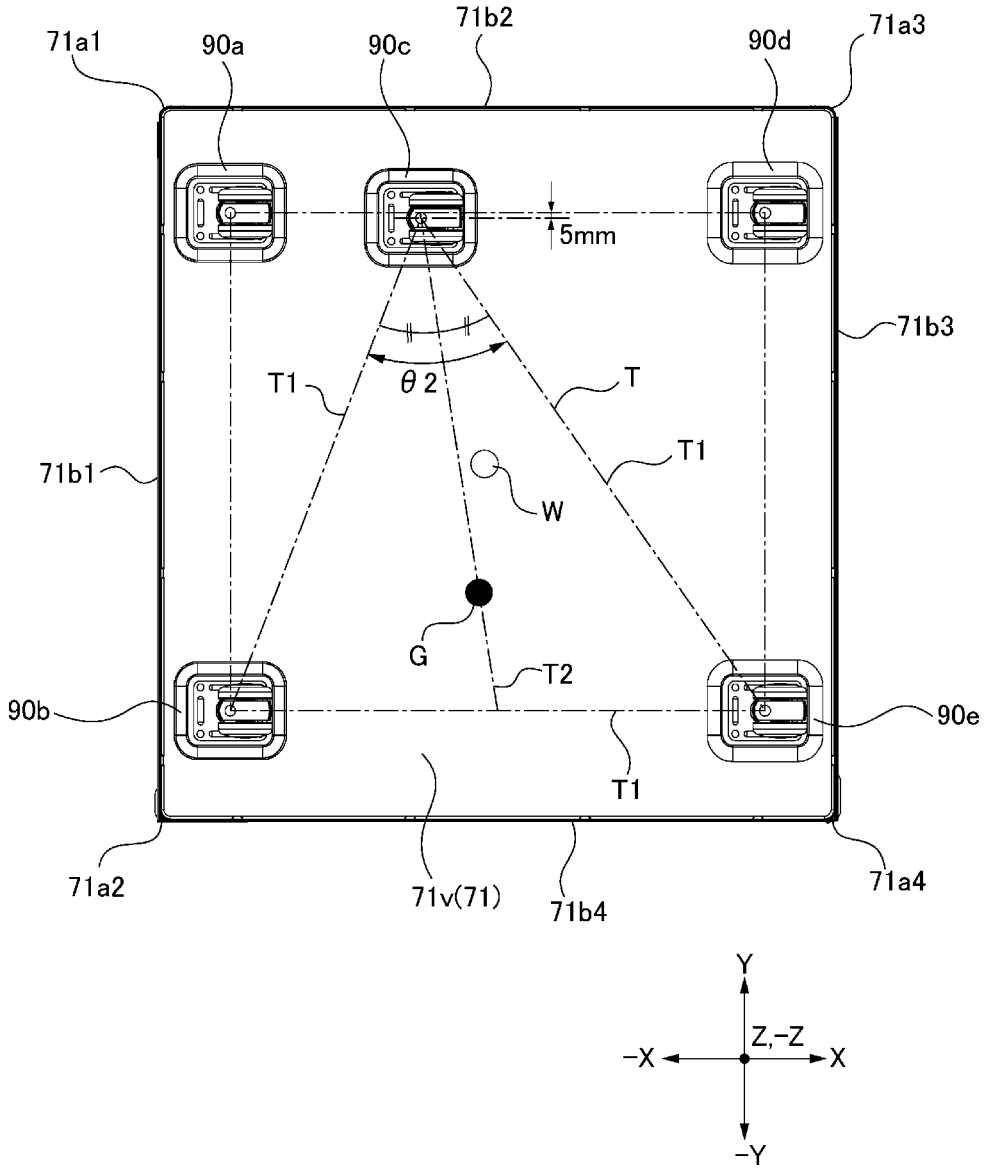
FIG. 10 illustrates a bottom plate viewed in the direction of arrow Z.

In this case, as illustrated in FIG. 10, the caster 90*c* is attached near the side 71*b*2 opposed to the side 71*b*4 connecting the corner portion 71*a*2 and the corner portion 71*a*4 of the substantially quadrangular bottom face 71*v* of the bottom plate 71. The vicinity of the side 71*b*2 of the substantially quadrangular bottom face 71*v* of the bottom plate 71 in which the caster 90*c* is disposed means the following position. That is the pivot 90*c*2 of the caster 90*c* is disposed inside any of the regions E1, E2, and E3 as the region of the row closest to the side 71*b*2, among the regions E1 to E9 illustrated in FIG. 7. The caster 90*c* is disposed such that the barycentric position G of the image forming apparatus A is located inside the triangle T formed by imaginary lines T1 connecting the casters 90*b*, 90*c*, and 90*e*. Specifically, the caster 90*c* is disposed such that the barycentric position G is located on the bisector T2 of the angle θ2 between the imaginary line connecting the casters 90*b* and 90*c* and the imaginary line connecting the casters 90*c* and 90*e*.

Figure 11:
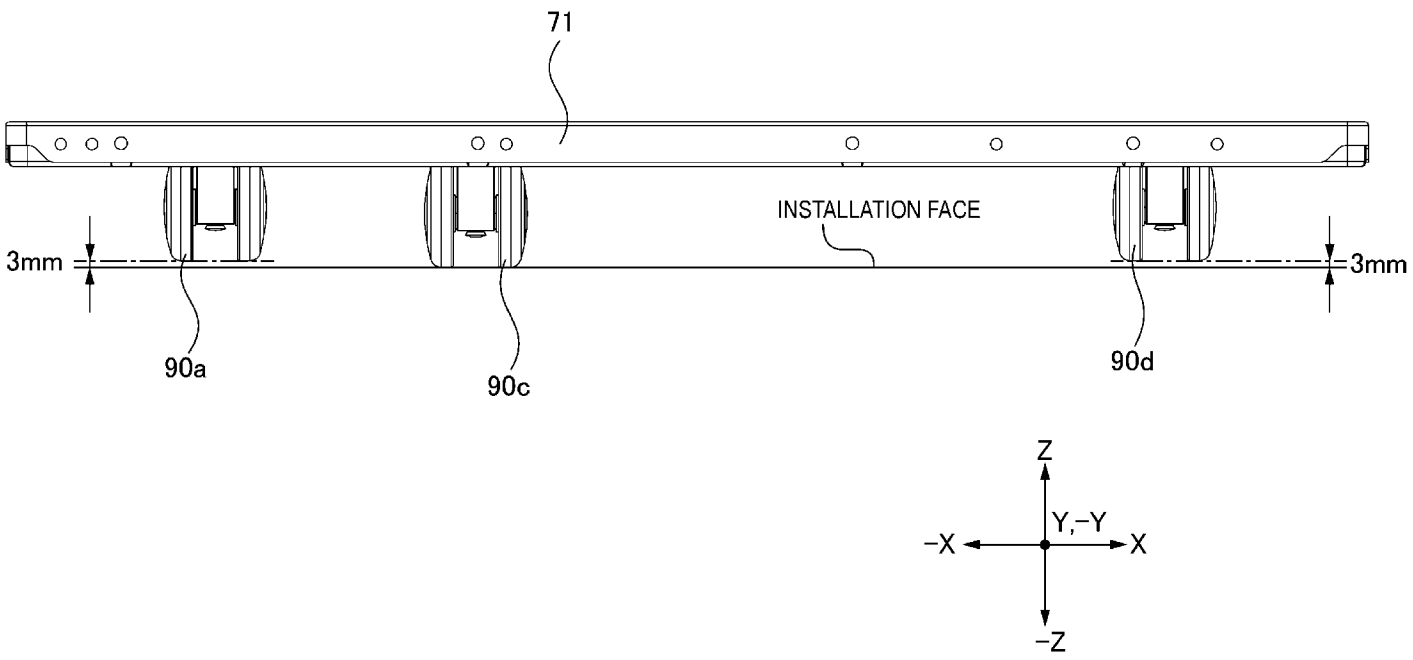
FIG. 11 illustrates the bottom plate viewed in the direction of arrow −Y.

As illustrated in FIG. 11, the casters 90*a* and 90*d* are disposed such that the respective lower end portions of the casters 90*a* and 90*d* are above the respective lower end portions of the casters 90*b*, 90*c*, and 90*e* in the vertical direction. Thus, in a case where the image forming apparatus A is installed on a flat installation face, the casters 90*b*, 90*c*, and 90*e* are installed on the installation face, and the caster 90*a* and 90*d* are located away from the installation face. Thus, the casters 90*a* and 90*d* each function as an auxiliary wheel to inhibit the image forming apparatus A from slanting, so that the image forming apparatus A can be inhibited from being unstable in attitude.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-086348, filed May 15, 2020, which is hereby incorporated by reference herein in its entirety.

What is claimed is:

1. An image forming apparatus, comprising:

an image forming unit configured to form a toner image on a sheet;

a frame including a support member configured to support the image forming unit, and a bottom plate disposed below the support member in a vertical direction, the bottom plate having the support member fixed to the bottom plate, the bottom plate having a bottom face to be opposed to an installation face for installation of the image forming apparatus, the bottom face being substantially quadrangular;

a first caster attached near a first corner portion of the bottom face of the bottom plate, the first caster being to be installed on the installation face;

a second caster attached near a second corner portion adjacent to the first corner portion of the bottom face of the bottom plate, the second caster being to be installed on the installation face;

a third caster attached near a second side opposed to a first side connecting the first corner portion and the second corner portion of the bottom face of the bottom plate, the third caster being to be installed on the installation face, the third caster being disposed such that a barycenter of the image forming apparatus is located inside a triangle formed by imaginary lines connecting the first caster, the second caster, and the third caster; and a fourth caster attached to a region outside the triangle on the bottom face of the bottom plate, the fourth caster being provided closer to the second side than the barycenter of the image forming apparatus in a direction orthogonal to the first side on the bottom face, the fourth caster being provided at a position different from the third caster in a direction in which the first side extends, wherein in a case where the image forming apparatus is installed on the installation face which is flat, the first caster, the second caster, and the third caster are installed on the installation face, and the fourth caster is located away from the installation face.

2. The image forming apparatus according to claim 1, wherein in the direction orthogonal to the first side, the fourth caster is disposed overlapping at least part of the third caster.

3. The image forming apparatus according to claim 1, wherein in the direction orthogonal to the first side, the fourth caster is disposed closer to the second side than the third caster is.

4. The image forming apparatus according to claim 1, wherein at least either the first caster or the second caster is disposed closer to the barycenter of the image forming apparatus than the fourth caster is.

5. The image forming apparatus according to claim 1, further comprising:

a fifth caster attached to the bottom face of the bottom plate, the fifth caster being outside the triangle, the fifth caster being disposed closer to the second side than the barycenter of the image forming apparatus in the direction orthogonal to the first side, the fifth caster being disposed at a position different from the third caster in the direction in which the first side extends, wherein in a case where the image forming apparatus is installed on the installation face which is flat, the fifth caster is located away from the installation face.

6. The image forming apparatus according to claim 1, further comprising:

a fixing unit supported by the support member, the fixing unit being capable of moving between a mount position at which the fixing unit is mounted in the image forming apparatus and a drawn position at which the fixing unit is drawn out of the mount position, the fixing unit being configured to fix the toner image formed by the image forming unit to the sheet, wherein in a case where the fixing unit is located at the drawn position, the barycenter of the image forming apparatus is located inside the triangle.

7. The image forming apparatus according to claim 1, further comprising:

a sheet cassette supported by the support member, the sheet cassette being capable of moving between a mount position at which the sheet cassette is mounted in the image forming apparatus and a drawn position at which the sheet cassette is drawn out of the mount position, the sheet cassette being configured to accommodate the sheet on which the toner image is to be formed by the image forming unit, wherein in a case where the sheet cassette is located at the drawn position, the barycenter of the image forming apparatus is located inside the triangle.

8. The image forming apparatus according to claim 1, further comprising:

a fifth caster attached to the bottom face of the bottom plate, the fifth caster being disposed outside of an imaginary plane defined by the first caster, the second caster and the third caster which respectively contact the installation face and being floated from the imaginary plane, wherein the fifth caster is disposed at an opposite side of the fourth caster for the third caster in an extending direction of the first side.

9. The image forming apparatus according to claim 1, further comprising:

a fixing unit configured to fix the toner image formed by the image forming unit to the sheet, wherein a direction perpendicular to the first side is a width direction of the image forming apparatus, wherein the fixing unit is disposed at a position closer to the first side than the second side.

10. The image forming apparatus according to claim 9, wherein the fixing unit supported by the support member, the fixing unit being capable of moving between a mount position at which the fixing unit is mounted in the image forming apparatus and a drawn position at which the fixing unit is drawn out of the mount position, wherein, in a case where the fixing unit is located at the drawn position, the barycenter of the image forming apparatus is located inside the triangle.

11. An image forming apparatus, comprising:

an image forming unit configured to form a toner image on a sheet;

a frame including a support member configured to support the image forming unit, and a bottom plate disposed below the support member in a vertical direction, the bottom plate having the support member fixed to the bottom plate, the bottom plate having a bottom face to be opposed to an installation face for installation of the image forming apparatus, the bottom face being substantially quadrangular;

a first caster attached near a first corner portion of the bottom face of the bottom plate, the first caster being to be installed on the installation face;

a second caster attached near a second corner portion adjacent to the first corner portion of the bottom face of the bottom plate, the second caster being to be installed on the installation face;

a third caster attached near a second side opposed to a first side connecting the first corner portion and the second corner portion of the bottom face of the bottom plate, the third caster being disposed between the first caster and the second caster in a direction in which the first side extends and being to be installed on the installation face; and a fourth caster attached to the bottom face of the bottom plate, the fourth caster being disposed outside of an imaginary plane defined by the first caster, the second caster and the third caster which respectively contact the installation face and being floated from the imaginary plane.

12. The image forming apparatus according to claim 11, wherein in the direction orthogonal to the first side, the fourth caster is disposed overlapping at least part of the third caster.

13. The image forming apparatus according to claim 11, wherein in the direction orthogonal to the first side, the fourth caster is disposed closer to the second side than the third caster is.

14. The image forming apparatus according to claim 11, further comprising:

a sheet cassette supported by the support member, the sheet cassette being capable of moving between a mount position at which the sheet cassette is mounted in the image forming apparatus and a drawn position at which the sheet cassette is drawn out of the mount position, the sheet cassette being configured to accommodate the sheet on which the toner image is to be formed by the image forming unit, wherein, in a case where the sheet cassette is located at the drawn position, the barycenter of the image forming apparatus is located inside the imaginary plane.

* * * * *